US008225843B2

(12) United States Patent
Kawamoto et al.

(10) Patent No.: US 8,225,843 B2
(45) Date of Patent: Jul. 24, 2012

(54) CONTINUOUS CASTING MOLD AND CONTINUOUS CASTING METHOD OF ROUND BILLET

(75) Inventors: Masayuki Kawamoto, Kashima (JP); Yuichi Tsukaguchi, Kashima (JP); Masahito Hanao, Kashima (JP); Atsushi Hirata, Wakayama (JP); Hiroshi Hayashi, Wakayama (JP); Manabu Adachi, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 79 days.

(21) Appl. No.: 12/579,495

(22) Filed: Oct. 15, 2009

(65) Prior Publication Data

US 2010/0032127 A1 Feb. 11, 2010

Related U.S. Application Data

(63) Continuation of application No. PCT/JP2007/064564, filed on Jul. 25, 2007.

(30) Foreign Application Priority Data

Jun. 28, 2007 (JP) ..... 2007-170396

(51) Int. Cl.
*B22D 11/08* (2006.01)

(52) U.S. Cl. ..... 164/441; 164/447

(58) Field of Classification Search ..... 164/441, 164/447

See application file for complete search history.

(56) References Cited

U.S. PATENT DOCUMENTS 5,853,043 A * 12/1998 Takeuchi et al. ..... 164/476

FOREIGN PATENT DOCUMENTS

| | | |
|---|---|---|
| JP | 59-165748 | 11/1984 |
| JP | 59-165749 | 11/1984 |
| JP | 08132184 A * | 5/1996 |
| JP | 3022211 | 1/2000 |
| JP | 2003-136203 | 5/2003 |

OTHER PUBLICATIONS

English computer translation JP 08132184 A.*

* cited by examiner

*Primary Examiner* — Jessica L Ward
*Assistant Examiner* — Erin Saad
(74) *Attorney, Agent, or Firm* — Clark & Brody

(57) ABSTRACT

In a mold for casting a billet with a curved type continuous casting apparatus, $D_0$ (m) is an inner diameter at a lower mold edge and $R_0$ (m) is a curvature radius of an outer curvature side at the lower mold edge. When a rate of change Tp (%/m) in mold inner diameter per unit length along a casting direction is $Tp=(1/D_0)\times(dD/dx)\times100$ (%/m), and when a rate of change Rp (%/m) in curvature radius of an outer curvature side per unit length along the casting direction is $Rp=(1/R_0)\times(dR/dx)\times100$ (%/m), the rate of change Tp in mold inner diameter and the rate of change Rp in curvature radius satisfy a relationship expressed $Rp=(Tp/2)\times(D_0/R_0)$, where D is a mold inner diameter at a distance x away from an upper mold edge and R in Formula 2 is a curvature radius of the outer curvature side at the distance x.

3 Claims, 5 Drawing Sheets

CONTINUOUS CASTING MOLD AND CONTINUOUS CASTING METHOD OF ROUND BILLET

This application is a continuation of International Patent Application No. PCT/JP2007/064564, filed Jul. 25, 2007. This PCT application was not in English as published under PCT Article 21(2).

TECHNICAL FIELD

The present invention relates to a continuous casting mold used in continuously casting round billets with a curved type continuous casting apparatus and a continuous casting method of round billets in which said continuous casting mold is used.

BACKGROUND ART

In continuously casting a round billet having a round shape cross section, compared with the continuous casting of a rectangular billet having a rectangular shape cross section, the billet is unevenly cooled because a mold inner wall (an inner peripheral surface in the case of the round billet mold) is unstably in contact with the billet. When the billet is excessively unevenly cooled, a longitudinal cracking defect is generated in the billet, and a break out is generated due to the longitudinal cracking defect. Therefore, the casting cannot be continued at last.

In order to circumvent the generation of such situation, there have been proposed such various methods that an inner diameter of the mold is decreased according to solidification shrinking, and mold powder fed into the mold are improved during the continuous casting to adjust contact between the mold inner peripheral surface and the billet. For example, Japanese Utility Model Application Publication No. 59 (1984)-165748 proposes a mold, in which an inner diameter is decreased downward and a decrease ratio of the inner diameter is changed in two steps. Further, Japanese Utility Model Application Publication No. 59 (1984)-165749 proposes a mold, in which a tapered surface whose inner diameter is continuously decreased downward and the change in inner diameter is matched with the solidification shrinking. According to the proposed molds, it is said that the uniform contact can be achieved between the mold inner peripheral surface and the billet.

However, in the mold proposed in Japanese Utility Model Application Publication No. 59 (1984)-165748 mentioned above, it is difficult to maintain the good contact between the mold inner peripheral surface and the billet in a whole region from an upper portion to a lower portion of the mold during the continuous casting. Moreover, in the mold proposed in Japanese Utility Model Application Publication No. 59 (1984)-165749 mentioned above, there is a problem in application, although it is possible theoretically that the good contact is maintained between the mold inner peripheral surface and the billet in the whole region from the upper portion to the lower portion of the mold during the continuous casting. That is, a solidification shrinking amount of the billet is difficult to be measured, and it is necessary to change the mold according to each steel grade because the solidification shrinking amount is changed when a chemical composition of steel to be cast is changed, and further, the shrinking amount of casting direction is changed when a casting speed is changed. Accordingly, such proposed molds cannot be used in a commercial operation.

The applicant has proposed a mold in Japanese Patent No. 3022211, in which the uniform contact is achieved between the mold inner peripheral surface and the billet to perform uniform cooling in continuously casting the round billet. The mold from the upper edge to the lower edge is divided into at least three regions along the casting direction, and the inner diameter of the mold is gradually decreased from the upper edge toward the lower edge by defining a rate of change in mold inner diameter per unit length along the casting direction in each region.

DISCLOSURE OF THE INVENTION

However, in the mold proposed in Japanese Patent No. 3022211 mentioned above, although heat transfer between the mold inner peripheral surface and the billet can be homogenized during the continuous casting, a condition on which the expected effect is obtained is restricted. For example, there is a problem that the casting cannot be performed in casting the steel having the different solidification shrinking amount or a problem in changing the casting speed. Particularly, the problem becomes prominent in the case where the inner peripheral surface of the mold is length-wise curved (hereinafter, "curved" generally is used to designate "length-wise curved") according to the shape of the billet like the continuous casting mold which is used to continuously cast the round billet with the curved type continuous casting apparatus.

In view of the foregoing, an object of the present invention is to provide a continuous casting mold which can stably perform the continuous casting of the casting-defect-free round billet and a continuous casting method in which the continuous casting mold is used when the round billet is continuously cast with the curved type continuous casting apparatus.

In order to achieve the object, the present invention provides a mold for continuously casting a round billet with a curved type continuous casting apparatus, the mold having an inner diameter $D_0$ (m) at a lower edge thereof, and an outer length-wise curvature (hereinafter, "curvature" is generally used to designate "length-wise curvature") surface having a curvature radius $R_0$ (m) at the lower edge of the mold, and at the same time the round billet continuous casting mold characterized in that, when a rate of change Tp (%/m) in mold inner diameter per unit length along a casting direction is expressed by Formula 1, and when a rate of change Rp (%/m) in curvature radius of an outer curvature side per unit length along the casting direction is expressed by Formula 2, the rate of change Tp in mold inner diameter and the rate of change Rp in curvature radius satisfy a relationship expressed by Formula 3;

$$Tp=(1/D_0)\times(dD/dx)\times 100\ (\%/\mathrm{m}) \qquad \text{Formula 1}$$

where D is a mold inner diameter at a distance x away from an upper edge of a cooled mold surface, $$Rp=(1/R_0)\times(dR/dx)\times 100\ (\%/\mathrm{m}) \qquad \text{Formula 2}$$

where R is a curvature radius of an outer curvature side at a distance x away from an upper edge of a cooled mold surface, and $$Rp=(Tp/2)\times(D_0/R_0). \qquad \text{Formula 3}$$

In the configuration of the present invention, because a center line of the inner peripheral surface of the mold is aligned with a center line of the billet in continuously casting the round billet, a biased force is not exerted to the billet from the mold and an even force is exerted over the whole circumference, and the uniform and good contact between the billet and the mold inner peripheral surface can be obtained over the whole circumference.

In the round billet continuous casting mold according to the present invention, preferably the mold is divided into three regions along the casting direction, the rate of change Tp in mold inner diameter ranges from 12 to 16%/m in a first region, the first region being allocated from an upper edge of a cooled mold surface to a zone of 50-100 mm, the cooled mold surface being the side which molten steel is poured to, the zone of 50-100 mm being between the positions of 50 mm and 100 mm away from the upper mold edge, the rate of change Tp in mold inner diameter continuously varies from 12-16%/m to 0.8-1.4%/m in a second region, the second region successively following the first region and being allocated from said zone of 50-100 mm to a zone of 250-300 mm, the zone of 250-300 mm being between the positions of 250 mm and 300 mm away from the upper mold edge, and the rate of change Tp in mold inner diameter ranges from 0.8 to 1.4%/m in a third region, the third region successively following the second region and being allocated from said zone of 250-300 mm to the lower edge of the mold.

In the round billet continuous casting mold according to the present invention, the rate of change Rp in curvature radius ranges from $6\times(D_0/R_0)$ to $8\times(D_0/R_0)$ (%/m) in a first region, the first region being from the upper edge of the cooled mold surface to the zone of 50-100 mm, the cooled mold surface being the side to which molten steel is poured, the zone of 50-100 mm being between the positions of 50 mm and 100 mm away from the upper mold edge, the rate of change Rp in curvature radius continuously varies from $6\times(D_0/R_0)$-$8\times(D_0/R_0)$ (%/m) to $0.4\times(D_0/R_0)$-$0.7\times(D_0/R_0)$ (%/m) in a second region, the second region successively following the first region and being allocated from said zone of 50-100 mm to a zone of 250-300 mm, the zone of 250-300 mm being between the positions of 250 mm and 300 mm away from the upper mold edge, and the rate of change Rp in curvature radius ranges from $0.4\times(D_0/R_0)$ to $0.7\times(D_0/R_0)$ (%/m) in a third region, the third region successively following the second region and being from said zone of 250-300 mm to the lower mold edge, preferably.

Further, in order to achieve the above-mentioned object, a round billet continuous casting method in which the round billet continuous casting mold is used, the round billet continuous casting method is characterized in that continuous casting is performed while a mold powder is being fed onto a surface of the molten steel poured into the continuous casting mold, wherein the mold powder having a viscosity of 0.1 to 1.0 Pa·s at 1573K, a solidification temperature of not less than 1273K, and a mass % ratio of 1.0 to 1.4 in terms of $((CaO+CaF_2\times0.718)/SiO_2)$, a Na content of not more than 5.0 mass % in $Na_2O$ equivalent, a F concentration of not more than 7.0 mass %, a Mg content of 5-13 mass % in MgO equivalent, and an Al content of 6-18 mass % in $Al_2O_3$ equivalent.

According to the round billet continuous casting mold of the invention and the continuous casting method of the present invention in which the mold is used, in the continuous casting with the curved type continuous casting apparatus, the uniform and good contact between the billet and the mold inner peripheral surface is achieved over the whole circumference because the force is evenly exerted to the whole circumference of the billet. As a result, the casting-defect-free high-quality round billet can stably be produced.

BEST MODE FOR CARRYING OUT THE INVENTION

The inventors studied in detail the problems involved in the conventional mold used in the curved type continuous casting apparatus, and the inventors completed the invention by paying attention to the curvature radius of the mold which the attention has not been given to because of a design standard.

Figure 1:
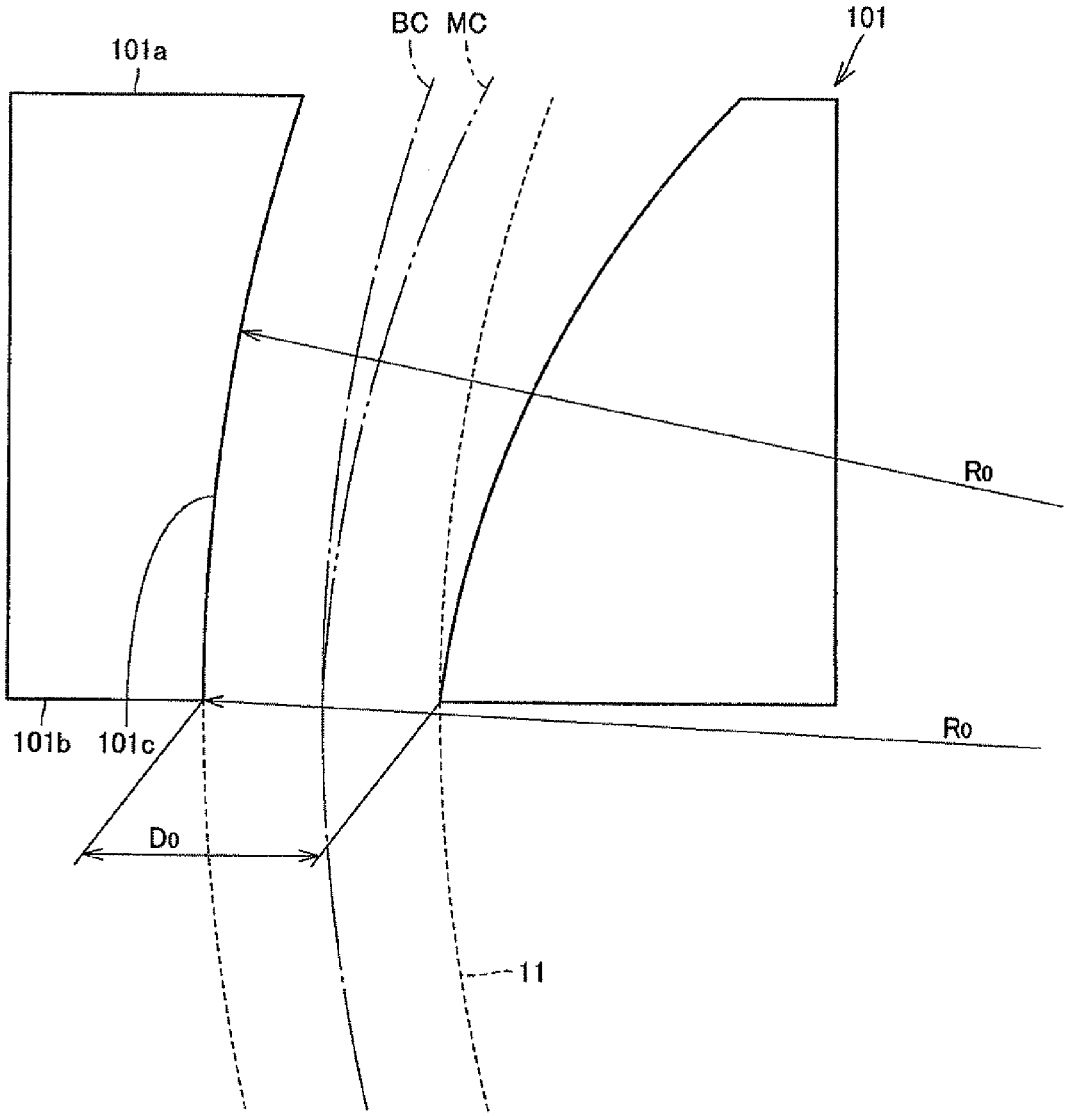
FIG. 1 is a vertical cross section showing a frame format of configuration of a conventional round billet continuous casting mold.

FIG. 1 is a vertical cross section showing a frame format of configuration of a conventional round billet continuous casting mold. As shown in FIG. 1, a conventional mold 101 used in the curved type continuous casting apparatus has a constant length-wise curvature radius $R_0$ of a datum line 101*c* along the outer length-wise curvature side in the inner peripheral surface. The curvature radius $R_0$ is substantially matched with the curvature radius of the outer curvature side of a billet 11 withdrawn from the mold 101. A mold inner diameter $D_0$ at its lower edge 101*b* is determined according to each diameter of the billet 11.

As with the molds proposed in Japanese Utility Model Application Publication No. 59 (1984)-165748, Japanese Utility Model Application Publication No. 59 (1984)-165749, and Japanese Patent No. 3022211, in an inner peripheral surface of the mold 101, the inner diameter of the mold 101 is shrunk from an upper edge 101*a* toward the lower edge 101*b*, namely, the inner peripheral surface is tapered in a length-wise direction such that the inner diameter is enlarged from the lower edge 101*b* toward the upper edge 101*a*. At this point, in the inner peripheral surface of the mold 101, because the outer curvature side is restricted by the constant curvature radius $R_0$, the enlargement of the inner diameter is born by the inner curvature side. Therefore, a center line MC, representing a plot of centers of the mold 101 inside diameters at elevations ranging from the lower edge 101*b* to the upper edge 101*a*, deviates from a center line BC which represents a center line of the billet to the inner curvature side toward the upper edge 101*a* of the mold 101, although matching with the center line BC at the lower edge 101*b*.

When the round billet 11 is continuously cast with the mold 101, a bias force is always exerted to the billet 11 from the inner curvature side toward the outer curvature side. Therefore, in the conventional mold 101, the billet comes into uneven contact with the inner peripheral surface of the mold 101 in the whole circumference, which results in a problem that the billet 11 is deformed. For example, in the case where the steel having a different solidification shrinking amount is cast, or in the case where a casting speed is changed during casting, the problem is very likely caused because the bias force exerted to the billet is changed.

In order to solve the problem, in the continuous casting mold of the present invention, not only the rate of change in mold inner diameter is defined, but also the rate of change in curvature radius of mold and the relationship between the rates of changes are defined.

That is, a mold according to the present invention is used to continuously cast a round billet with a curved type continuous casting apparatus, assuming that $D_0$ (m) is a mold inner diameter at a lower edge of the mold and $R_0$ (m) is a curvature radius of an outer curvature side at the lower edge of the mold, when a rate of change Tp (%/m) in mold inner diameter per unit length along a casting direction is expressed by Formula 1, and when a rate of change Rp (%/m) in curvature radius of an outer curvature side per unit length along the casting direction is expressed by Formula 2, the rate of change Tp in mold inner diameter and the rate of change Rp in curvature radius satisfy a relationship expressed by Formula 3;

$$Tp=(1/D_0)\times(dD/dx)\times 100\ (\%/m) \qquad \text{Formula 1}$$

where D is a mold inner diameter at a distance x away from an upper edge of a cooled mold surface, $$Rp=(1/R_0)\times(dR/dx)\times 100\ (\%/m) \qquad \text{Formula 2}$$

where R is a curvature radius of an outer curvature side at a distance x away from an upper edge of a cooled mold surface, and $$Rp=(Tp/2)\times(D_0/R_0). \qquad \text{Formula 3}$$

Figure 2:
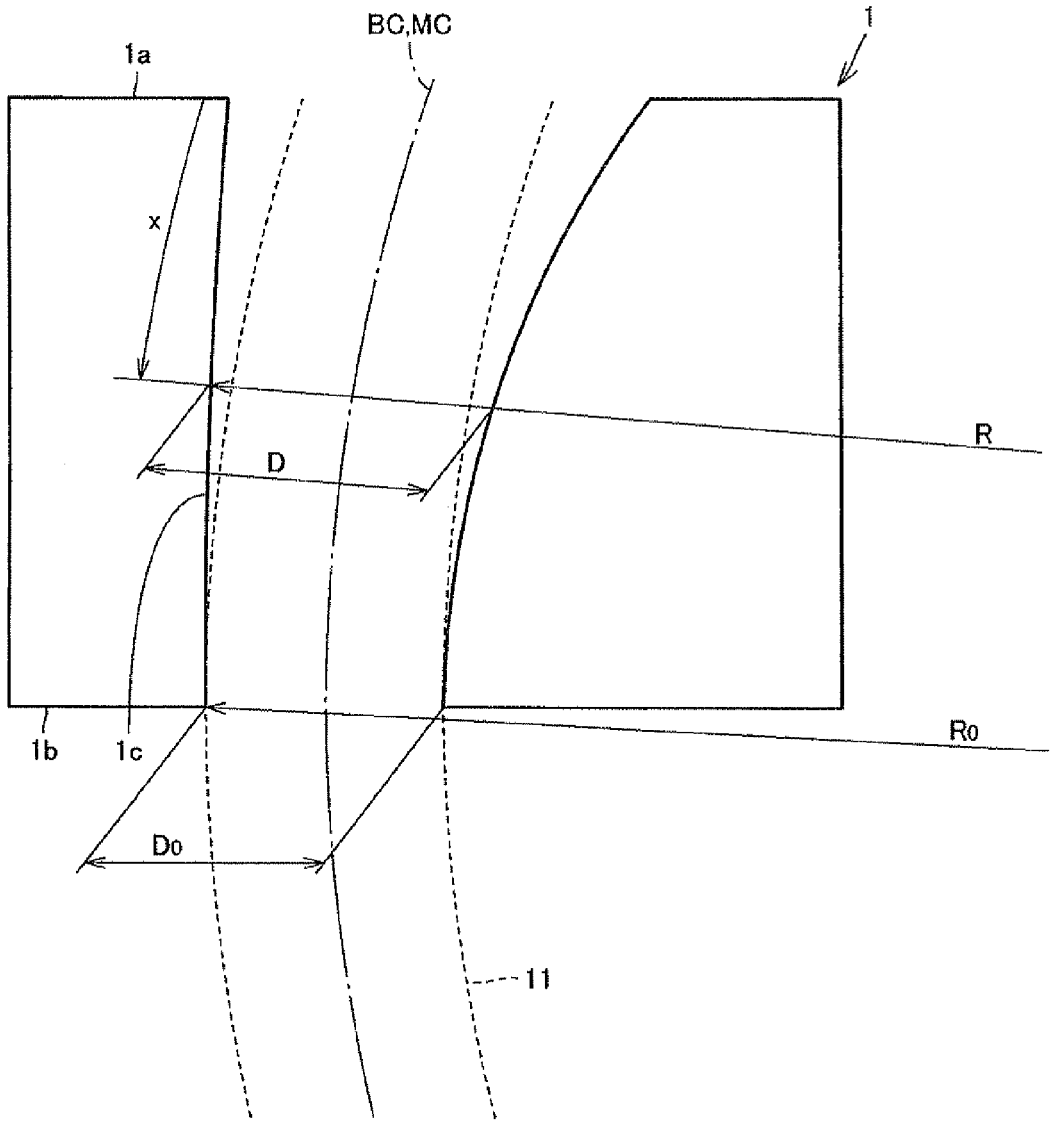
FIG. 2 is a vertical cross section showing a frame format of configuration of a round billet continuous casting mold according to the present invention.

FIG. 2 is a vertical cross section showing a frame format of configuration of a round billet continuous casting mold according to the present invention. As shown in FIG. 2, in a mold 1 according to the invention used in the curved type continuous casting apparatus, it is assumed that $D_0$ is the inner diameter at a lower edge 1*b* of the mold 1 and $R_0$ is the curvature radius of a datum line 1*c* along the outer curvature side in the inner peripheral surface at the lower edge 1*b* of the mold 1. The mold inner diameter $D_0$ at the lower edge 1*b* of the mold is determined according to each diameter of the billet 11 to be cast. The curvature radius $R_0$ at the lower edge 1*b* of the mold 1 is substantially matched with the curvature radius of the outer curvature side of the billet 11 withdrawn from the mold 1, which is inherently owned by the applied curved type continuous casting apparatus.

The inner peripheral surface of the mold 1 has a lengthwise tapered shape such that the inner diameter thereof is gradually increased from the lower edge 1*b* toward the upper edge 1*a*. At this point, assuming that D is a mold inner diameter at a distance x from the upper edge 1*a* of the cooled mold surface, the rate of change Tp in mold inner diameter can be expressed by Formula 1. Similarly, assuming that at a distance x from the upper edge 1*a* of the cooled mold surface, R is a curvature radius of the datum line 1*c* along the outer curvature side, the rate of change Rp in curvature radius at this position can be expressed by Formula 2. And, the mold inner diameter D and the curvature radius R are set at the distance x away from the upper edge 1*a* of the cooled mold surface such that at this position, the rate of change Tp in mold inner diameter and the rate of change Rp in curvature radius satisfy Formula 3.

When the mold inner diameter D and the curvature radius R are set according to the definition of Formula 3, the inner diameter is gradually increased from the lower edge 1*b* toward the upper edge 1*a* in the inner peripheral surface of the mold 1 while the increase in inner diameter is evenly distributed to the outer curvature side and the inner curvature side. That is, a center line MC representing a plot of inside diameter centers at elevations ranging from the lower edge 1*b* and the upper edge 1*a* is matched with a center line BC of the round billet 11 over the whole region from the lower edge 1*b* to the upper edge 1*a* of the mold 1.

The reason why such situation is defined by Formula 3 is as follows. In order to match the center line MC of the mold inner peripheral surface with the center line BC of the billet, it is necessary that the increase in inner diameter of the mold 1 be evenly distributed to the outer curvature side and the inner curvature side while centering around the center line BC of the billet 11. Therefore, it is necessary that a half (½) of the rate of change Tp in mold inner diameter is assigned to the curvature radius R of the outer curvature side at the distance x away from the upper edge 1*a* of the mold surface. This enables the curvature radius R of the outer curvature side to be expressed by a following Formula 4 based on the rate of change Tp in mold inner diameter:

$$R=R_0+D_0\times(Tp/2). \qquad \text{Formula 4}$$

Similarly, the curvature radius R of the outer curvature side can be expressed by a following Formula 5 based on the rate of change Rp in curvature radius:

$$R=R_0+R_0\times Rp. \qquad \text{Formula 5}$$

Formula 3 can be derived from the relationship between Formula 4 and 5. Therefore, when the relationship expressed by Formula 3 is satisfied, the center line MC of the mold inner peripheral surface is matched with the center line BC of the billet 11.

According to the continuous casting mold of the present invention, in performing the continuous casting of the round billet with the mold, because the center line of the mold inner peripheral surface is matched with the center line of the billet, the mold does not exert the biased force to the billet, and the even force is exerted to the whole circumference of the billet. Therefore, the uniform and good contact between the billet and the mold inner peripheral surface is achieved over the whole circumference, which allows the high-quality round billet to be stably obtained. The same holds true for the case in which the steel having the different solidification shrinking amount is cast or the case in which the casting speed is changed during the casting.

Then, a preferred example of the continuous casting mold of the present invention will be described in the followings.

In the specific example, the continuous casting mold is divided into three regions along the casting direction, the rate of change Tp in mold inner diameter ranges from 12 to 16%/m in a first region, the first region being allocated from an upper edge of a cooled mold surface to a zone of 50-100 mm, the mold surface being the side which molten steel is poured to, the zone of 50-100 mm being between the positions of 50 mm and 100 mm away from the upper mold edge, the rate of change Tp in mold inner diameter of continuously varies from 12-16%/m to 0.8-1.4%/m in a second region, the second region successively following the first region and being allocated from said zone of 50-100 mm to a zone of 250-300 mm, the zone of 250-300 mm being between the positions of 250 mm and 300 mm away from the upper mold edge, and the rate of change Tp in mold inner diameter ranges from 0.8 to 1.4%/m in a third region, the third region successively following the second region and being from said zone of 250-300 mm to the lower edge of the mold. At this point, the rate of change Rp in curvature radius is determined so as to satisfy the relationship of Formula 3 based on the rate of change Tp in mold inner diameter.

In other words, the rate of change Rp in curvature radius ranges from $6\times(D_0/R_0)$ to $8\times(D_0/R_0)$ (%/m) in a first region, the first region being allocated from an upper edge of a cooled mold surface to a zone of 50-100 mm, the mold surface is the side which molten steel is poured to, the zone of 50-100 mm being between the positions of 50 mm and 100 mm away from the upper mold edge, the rate of change Rp in curvature radius continuously varies from $6\times(D_0/R_0)$-$8\times(D_0/R_0)$ (%/m) to $0.4\times(D_0/R_0)-0.7\times(D_0/R_0)$ (%/m) in a second region, the second region successively following the first region and being from said zone of 50-100 mm to a zone of 250-300 mm, the zone of 250-300 mm being between the positions of 250 mm and 300 mm away from the upper mold edge, and the rate of change Rp in curvature radius ranges from $0.4\times(D_0/R_0)$ to $0.7\times(D_0/R_0)$ (%/m) in a third region, the third region successively following the second region and being from said zone of 250-300 mm to the lower edge of the mold. At this point, the rate of change Tp in mold inner diameter is determined so as to satisfy the relationship of Formula 3 based on the rate of change Rp in curvature radius.

Figure 3:
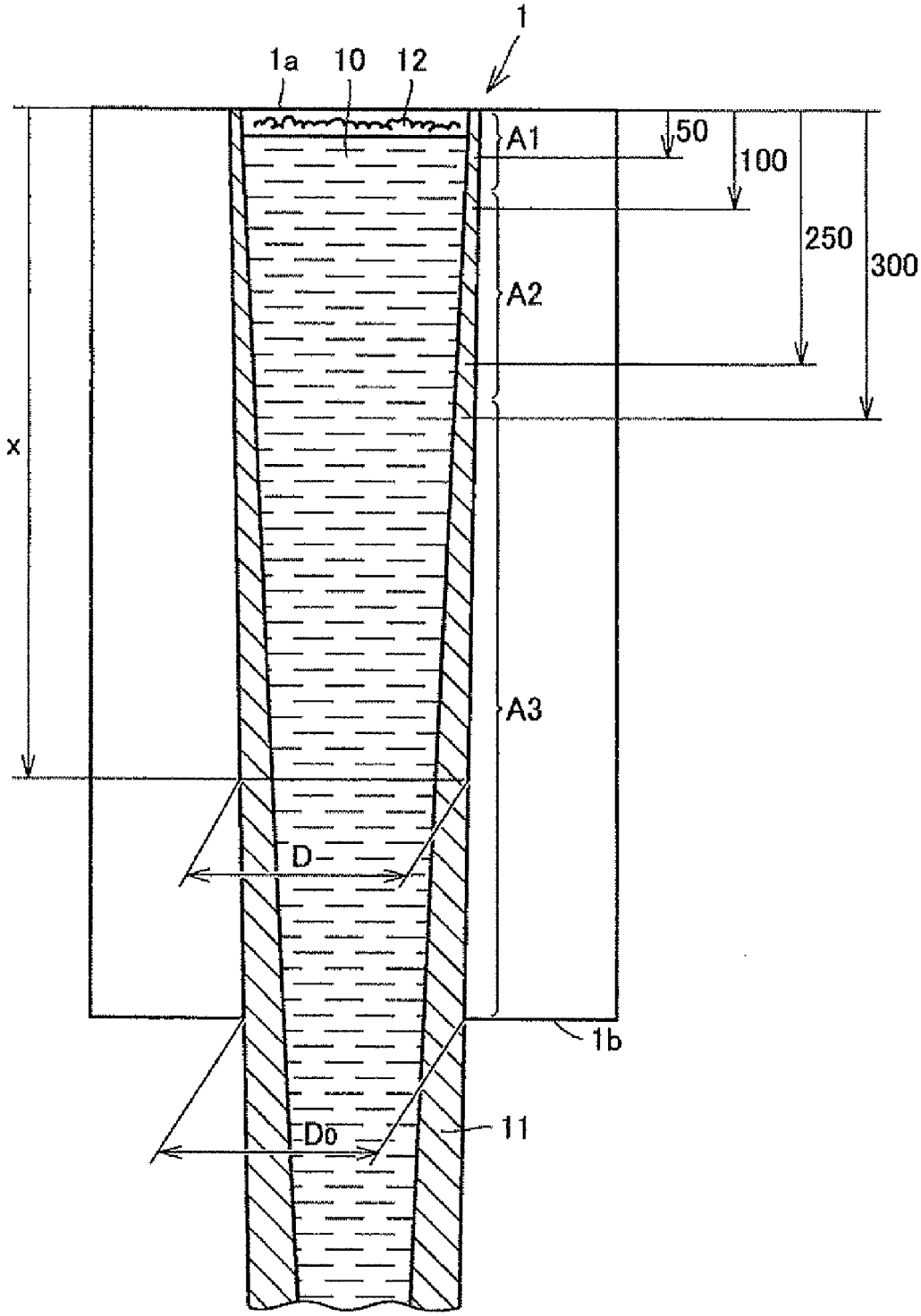
FIG. 3 is a vertical cross section for explaining a specific example of the round billet continuous casting mold of the invention.

FIG. 3 is a vertical cross section for explaining a specific example of the round billet continuous casting mold of the invention. For convenience, the tapered inner peripheral surface of the mold is constant and the curved state is not shown in FIG. 3.

As shown in FIG. 3, the mold 1 of the present invention to the lower edge 1*b* from the upper edge 1*a* of a cooled mold surface side where molten steel 10 is poured is divided into three regions A1, A2, and A3 along the casting direction. A boundary between the first region A1 and the second region A2 is located within a zone ranging from 50 to 100 mm from the upper edge 1*a* of the cooled mold surface side, and a boundary between the second region A2 and the third region A3 is located within a zone ranging from 250 to 300 mm from the upper edge 1*a* of the cooled mold surface. The rate of change Tp in mold inner diameter is set to 12 to 16%/m in the first region A1, the rate of change Tp in mold inner diameter is continuously varied from 12-16%/m to 0.8-1.4%/m in the second region A2 which successively follows the first region A1, and the rate of change Tp in mold inner diameter of the mold is set to 0.8-1.4%/m in the third region A3 which successively follows the second region A2. During the continuous casting, mold powders 12 are fed onto the surface of the molten steel 10 in the mold 1.

The reason why the rate of change Tp in mold inner diameter is set to the range of 12 to 16%/m in the first region that is allocated from the upper mold edge to the zone of 50-100 mm is that the first region is used to effectively achieve the uniform contact between the mold inner peripheral surface and the billet. That is, when the first region is shorter than 50 mm, the shrinking of the mold becomes smaller than the shrinking of the solidified shell, which causes the non-uniform contact to generate longitudinal cracking. On the other hand, when the first region is longer than 100 mm, the shrinking of the mold becomes excessively large to generate constraint due to the seizure between the mold and billet. The constraint is generated when the rate of change Tp in mold inner diameter is excessively larger than a specified value, and the longitudinal cracking is generated when the rate of change Tp in mold inner diameter of the mold is excessively smaller than the specified value.

The reason why the rate of change Tp in mold inner diameter is continuously varied from 12-16%/m to 0.8-1.4%/m in the second region that is allocated next to the first region and from said zone of 50-100 mm to the zone of 250-300 mm, is that when the second region is shorter than the range determined by the datum point of 250 mm, the shrinking of the mold becomes smaller than the shrinking of the solidified shell, which causes the non-uniform contact to generate longitudinal cracking. On the other hand, when the second region is longer than the range determined by the datum point of 300 mm, the shrinking of the mold becomes excessively large to generate constraint due to the seizure between the mold and the billet. The seizure-related constraint is generated when the rate of change Tp in mold inner diameter is excessively larger than the specified value, and the longitudinal cracking is generated when the rate of change Tp in mold inner diameter is excessively smaller than the specified value. Further, in the third region between the end of the second region and the lower mold edge, it is for the same reason that the rate of change Tp in mold inner diameter is set to the range of 0.8 to 1.4%/m.

The use of the continuous casting mold of the specific example can achieve the better contact between the billet and the mold inner peripheral surface to obtain the high-quality round billet. As for the mold powder which constitutes a heat transfer medium between the mold inner peripheral surface and the billet, a material having the following physical properties and composition is used in the mold of the present invention, which allows the higher-quality round billet to be obtained compared with the use of the conventional mold powder.

The mold powder having the following physical properties and composition can be used in the round billet continuous casting mold of the invention. That is, a viscosity of 0.1 to 1.0 Pa·s at 1573K, a solidification temperature of not less than 1273K, and a mass % ratio of 1.0 to 1.4 in terms of $((CaO+CaF_2\times0.718)/SiO_2)$, a Na content of not more than 5.0 mass % in $Na_2O$ equivalent, a F concentration of not more than 7.0 mass %, a Mg content of 5 to 13 mass % in MgO equivalent, and an Al content of 6 to 18 mass % in $Al_2O_3$ equivalent. Table 1 shows the physical properties and composition of the mold powder.

TABLE 1

| | |
|---|---|
| Viscosity at 1573K | 0.1 to 1.0 Pa · s |
| Solidification temperature | 1273 K or more |
| Mass % ratio in terms of $((CaO + CaF_2 \times 0.718)/SiO_2)$ | 1.0 to 1.4 |
| Na content in $Na_2O$ equivalent | 5.0 mass % or less |
| F concentration | 7.0 mass % or less |
| Mg content in MgO equivalent | 5 to 13 mass % |
| Al content in $Al_2O_3$ equivalent | 6 to 18 mass % |

(Note)
*Solidification temperature expresses a temperature at which viscosity rises rapidly in viscosity measurement.
*Because usually a cationic concentration is determined in a chemical analysis value, the content is defined by converting the chemical analysis value into a concentration in oxide equivalent.
*For CaO, the value is expressed by converting a Ca concentration into a Cao concentration.

In the mold powder, when the viscosity at 1573K is lower than 0.1 (Pa·S), the powder is non-uniformly poured between the mold inner peripheral surface and the billet, and the heat is non-uniformly dissipated. This causes the generation of the longitudinal cracking or seizure-related constraint and/or the defect by migrating the powder into molten steel. On the other hand, when the viscosity is more than 1.0 Pa·s, the lack of the inflow of the powder between the mold inner peripheral surface and the billet causes the generation of the seizure-related constraint.

When the solidification temperature is lower than 1273K, a liquid phase of the powder is increased between the mold inner peripheral surface and the billet, and the cooling is excessively provided. Therefore, the billet is distorted by a thermal stress to generate the longitudinal cracking.

When the mass % ratio in terms of $((CaO+CaF_2\times0.718)/SiO_2)$ is lower than 1.0, $SiO_2$ in the powder oxidizes Mn in the molten steel to change the composition, and the defect is generated in the billet surface. And when the Mg content in MgO equivalent is lower than 5 mass %, because crystallization is not stabilized, the cooling is excessively provided to generate the longitudinal cracking. On the other hand, when the mass % ratio in terms of $((CaO+CaF_2\times0.718)/SiO_2)$ is more than 1.4, or when the Mg content in MgO equivalent is more than 13 mass %, the powder film is excessively shrunk, and the good contact is disturbed between the billet and the mold inner peripheral surface to generate the longitudinal cracking, or the powder is not melted because the solidification temperature is associated to become excessively high.

When the Na content in $Na_2O$ equivalent is more than 5.0 mass %, or when F concentration is more than 7.0 mass %, a melting behavior of the powder becomes defective to generate an entrapment defect, etc.

When the Al content in $Al_2O_3$ equivalent is less than 6 mass %, the composition of the crystal is changed during the casting to non-uniformly provide the cooling. On the other hand, when the Al content in $Al_2O_3$ equivalent is more than 18 mass %, the powder is hardly flowed inbetween the billet and the mold inner peripheral surface because the solidification temperature is associated to become excessively high.

Accordingly, the round billet having the better quality can be produced, when the continuous casting is performed while the mold powder having the physical properties and composition defined as described above is fed onto the surface of the molten steel in the mold of the present invention.

EXAMPLES

Tests were performed with a curved type continuous casting apparatus which has an one-point straightening device in order to confirm the effects of the mold of the present invention and the continuous casting method in which the mold was used. The curved type continuous casting apparatus which has an one-point straightening device had the curvature radius ($R_0$) of 10 m. The steels having C ranging from 0.06 to 0.35 mass % and Mn ranging from 0.8 to 1.8 mass % were used in the test of the embodiment. Although it is not always necessary to contain Cr, Cr is set to less than 3 mass % when Cr is contained. The casting tests were performed with three steel grades A, B, and C shown in Table 2.

TABLE 2

| Steel | Chemical composition (mass %) Balance: Fe and impurities | | | | | | |
|---|---|---|---|---|---|---|---|
| grade | C | Mn | Si | P | S | Cr | Al |
| A | 0.27 | 0.41 | 0.26 | 0.0080 | 0.0030 | 0.97 | 0.035 |
| B | 0.23 | 1.29 | 0.30 | 0.0110 | 0.0060 | 0.46 | 0.025 |
| C | 0.22 | 0.61 | 0.18 | 0.0220 | 0.0060 | — | 0.018 |

(Note)
"—" shows that the element is not contained.

In the embodiment, the molten steel was poured into molds M1 to M20 (having the inner diameter ($D_0$) of 225 mm at the lower edge of the mold and the length of 900 mm) shown in Table 3, mold powder P1 to P11 shown in Table 4 was fed onto the surface of the molten steel, and the continuous casting was performed at a casting speed of 2.0 m/min. Table 5 shows casting conditions A to AF which are in combination of the steel grades A to C, the molds M1 to M20, and the powder P1 to P11 in the embodiment.

TABLE 3

| | | M1 | M2 | M3 | M4 | M5 | M6 | M7 | M8 | M9 | M10 |
|---|---|---|---|---|---|---|---|---|---|---|---|
| First region | Boundary of second region (mm) | 40* | 110* | 75 | 75 | 75 | 75 | 75 | 75 | 50 | 100 |
| | Rate of change in mold inner diameter (%/m) | 14.0 | 14.0 | 11.0* | 17.0* | 14.0 | 14.0 | 14.0 | 14.0 | 14.0 | 14.0 |
| | Rate of change in curvature radius (%/m) | 0.158 | 0.158 | 0.124 | 0.191 | 0.158 | 0.158 | 0.158 | 0.158 | 0.158 | 0.158 |
| Second region | Boundary of third region (mm) | 275 | 275 | 275 | 275 | 240* | 310* | 275 | 275 | 275 | 275 |
| | Rate of change in mold inner diameter in first region (%/m) | 14.0 | 14.0 | 11.0* | 17.0* | 14.0 | 14.0 | 14.0 | 14.0 | 14.0 | 14.0 |
| | Rate of change in mold inner diameter in third region (%/m) | 1.1 | 1.1 | 1.1 | 1.1 | 1.1 | 1.1 | 0.7 | 1.5 | 1.1 | 1.1 |
| | Rate of change in curvature radius in first region (%/m) | 0.158 | 0.158 | 0.124 | 0.191 | 0.158 | 0.158 | 0.158 | 0.158 | 0.158 | 0.158 |
| | Rate of change in curvature radius in third region (%/m) | 0.012 | 0.012 | 0.012 | 0.012 | 0.012 | 0.012 | 0.008 | 0.017 | 0.012 | 0.012 |
| Third region | Rate of change in mold inner diameter (%/m) | 1.1 | 1.1 | 1.1 | 1.1 | 1.1 | 1.1 | 0.7* | 1.5* | 1.1 | 1.1 |
| | Rate of change in curvature radius (%/m) | 0.012 | 0.012 | 0.012 | 0.012 | 0.012 | 0.012 | 0.008 | 0.017 | 0.012 | 0.012 |
| | Classification | C | C | C | C | C | C | C | C | I | I |

| | | M11 | M12 | M13 | M14 | M15 | M16 | M17 | M18 | M19 | M20 |
|---|---|---|---|---|---|---|---|---|---|---|---|
| First region | Boundary of second region (mm) | 75 | 75 | 75 | 75 | 75 | 75 | 75 | 75 | 75 | 75 |
| | Rate of change in mold inner diameter (%/m) | 12.0 | 16.0 | 14.0 | 14.0 | 14.0 | 14.0 | 14.0 | 14.0 | 14.0 | 14.0 |
| | Rate of change in curvature radius (%/m) | 0.135 | 0.180 | 0.158 | 0.158 | 0.158 | 0.158 | 0.158 | 0* | 0* | 0* |
| Second region | Boundary of third region (mm) | 275 | 275 | 250 | 300 | 275 | 275 | 275 | 275 | 275 | 275 |
| | Rate of change in mold inner diameter in first region (%/m) | 12.0 | 16.0 | 14.0 | 14.0 | 14.0 | 14.0 | 14.0 | 14.0 | 14.0 | 14.0 |

TABLE 3-continued

| | | | | | | | | | | | |
|---|---|---|---|---|---|---|---|---|---|---|---|
| | Rate of change in mold inner diameter in third region (%/m) | 1.1 | 1.1 | 1.1 | 1.1 | 1.1 | 0.8 | 1.4 | 1.1 | 0.8 | 1.4 |
| | Rate of change in curvature radius in first region (%/m) | 0.135 | 0.180 | 0.158 | 0.158 | 0.158 | 0.158 | 0.158 | 0* | 0* | 0* |
| | Rate of change in curvature radius in third region (%/m) | 0.012 | 0.012 | 0.012 | 0.012 | 0.012 | 0.009 | 0.016 | 0* | 0* | 0* |
| Third region | Rate of change in mold inner diameter (%/m) | 1.1 | 1.1 | 1.1 | 1.1 | 1.1 | 0.8 | 1.4 | 1.1 | 0.8 | 1.4 |
| | Rate of change in curvature radius (%/m) | 0.012 | 0.012 | 0.012 | 0.012 | 0.012 | 0.009 | 0.016 | 0* | 0* | 0* |
| | Classification | I | I | I | I | I | I | I | C | C | C |

(Note)
In classification, "I" means Inventive example" and C" means Comparative example.
"*" shows that the numerical data deviates from the range defined in the present invention.

TABLE 4

| | P1 | P2 | P3 | P4 | P5 | P6 | P7 | P8 | P9 | P10 | P11 |
|---|---|---|---|---|---|---|---|---|---|---|---|
| Viscosity (Pa · s) | 0.50 | 0.40 | 0.60 | 040 | 0.60 | 0.35 | 0.36 | 0.49 | 0.52 | 0.48 | 0.53 |
| Solidification temperature (K) | 1505 | 1512 | 1495 | 1600 | 1460 | 1465 | 1463 | 1505 | 1520 | 1500 | 1520 |
| Basicity (—) | 1.20 | 1.40 | 1.00 | 1.45* | 0.95* | 1.20 | 1.20 | 1.20 | 1.20 | 1.20 | 1.20 |
| $Na_2O$ (mass %) | 0.5 | 0.5 | 0.5 | 0.5 | 0.5 | 6.0* | 0.5 | 4.0 | 2.0 | 4..0 | 4.0 |
| F (mass %) | 4.0 | 4.0 | 4.0 | 4.0 | 4.0 | 4.0 | 8.0* | 4.0 | 4.0 | 4.0 | 4.0 |
| MgO (mass %) | 8.0 | 8.0 | 8.0 | 8.0 | 8.0 | 8.0 | 8.0 | 6.0 | 13.0 | 8.0 | 8.0 |
| $Al_2O_3$ (mass %) | 11.0 | 11.0 | 11.0 | 11.0 | 11.0 | 11.0 | 11.0 | 11.0 | 11.0 | 7.0 | 18.0 |
| Classification | I | I | I | C | C | C | C | I | I | I | I |

(Note)
Basicity means the mass ratio of (CaO + CaF2 × 0.718)/SiO2.
In classification, "I" means Inventive example and "C" means Comparative example.
"*" shows that the numerical data deviates from the range defined in the present invention.

TABLE 5

| Casting condition | A | B | C | D | E | F | G | H | I | J | K |
|---|---|---|---|---|---|---|---|---|---|---|---|
| Steel grade | A | A | A | A | A | A | A | A | A | A | A |
| Mold | M1* | M2* | M3* | M4* | M5* | M6* | M7* | M8* | M9 | M10 | M11 |
| Mold powder | P1 | P1 | P1 | P1 | P1 | P1 | P1 | P1 | P1 | P1 | P1 |
| Classification | C | C | C | C | C | C | C | C | I | I | I |

| Casting condition | L | M | N | O | P | Q | R | S | T | U | V |
|---|---|---|---|---|---|---|---|---|---|---|---|
| Steel grade | A | A | A | A | A | A | A | A | A | A | A |
| Mold | M12 | M13 | M14 | M15 | M16 | M17 | M18* | M19* | M20* | M15 | M15 |
| Mold powder | P1 | P1 | P1 | P1 | P1 | P1 | P1 | P1 | P1 | P2 | P3 |
| Classification | I | I | I | I | I | I | C | C | C | I | I |

| Casting condition | W | X | Y | Z | AA | AB | AC | AD | AE | AF |
|---|---|---|---|---|---|---|---|---|---|---|
| Steel grade | A | A | A | A | A | A | A | A | B | C |
| Mold | M15 | M15 | M15 | M15 | M15 | M15 | M15 | M15 | M15 | M15 |
| Mold powder | P4* | P5* | P6* | P7* | P8 | P9 | P10 | P11 | P1 | P1 |
| Classification | C | C | C | C | I | I | I | I | I | I |

(Note)
In classification, "I" means Inventive example and "C" means Comparative example.
"*" shows that the numerical data deviates from the range defined in the present invention.

The test result was evaluated by a variation range in mold copper surface temperature representing how is the contact between the mold inner peripheral surface and the billet, an index of the longitudinal cracking, and the presence or absence of a withdrawal-disabled accident.

Figure 4:
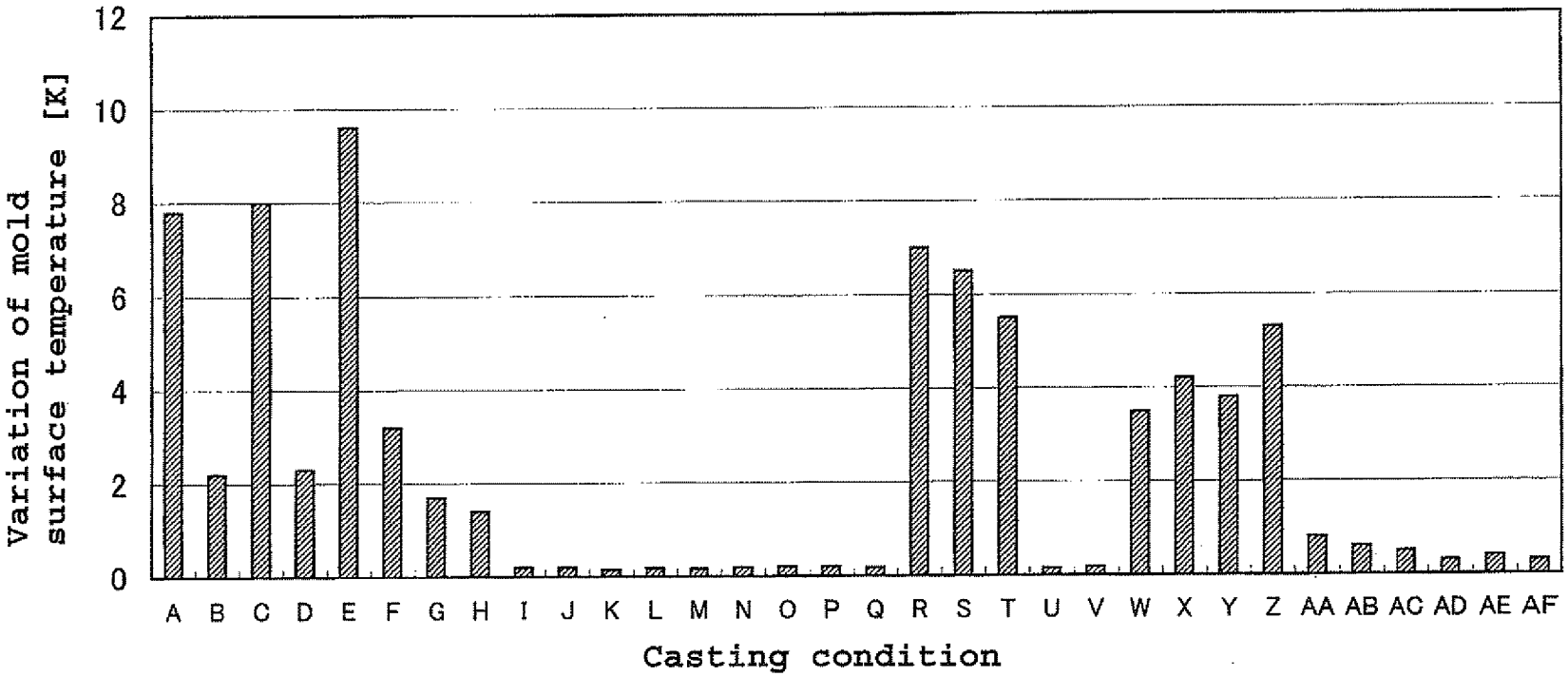
FIG. 4 is a diagram showing a variation range of a mold copper surface temperature for each casting condition in embodiment.

FIG. 4 is a diagram showing a variation range of a mold copper surface temperature for each casting condition in the embodiment. The mold temperature variation range of FIG. 4 shows an effective value (numeric integration average) of the temperature variation of a thermocouple disposed 150 mm away from the upper edge of the mold surface. The thermocouple was disposed inside by 15 mm from the copper surface.

Figure 5:
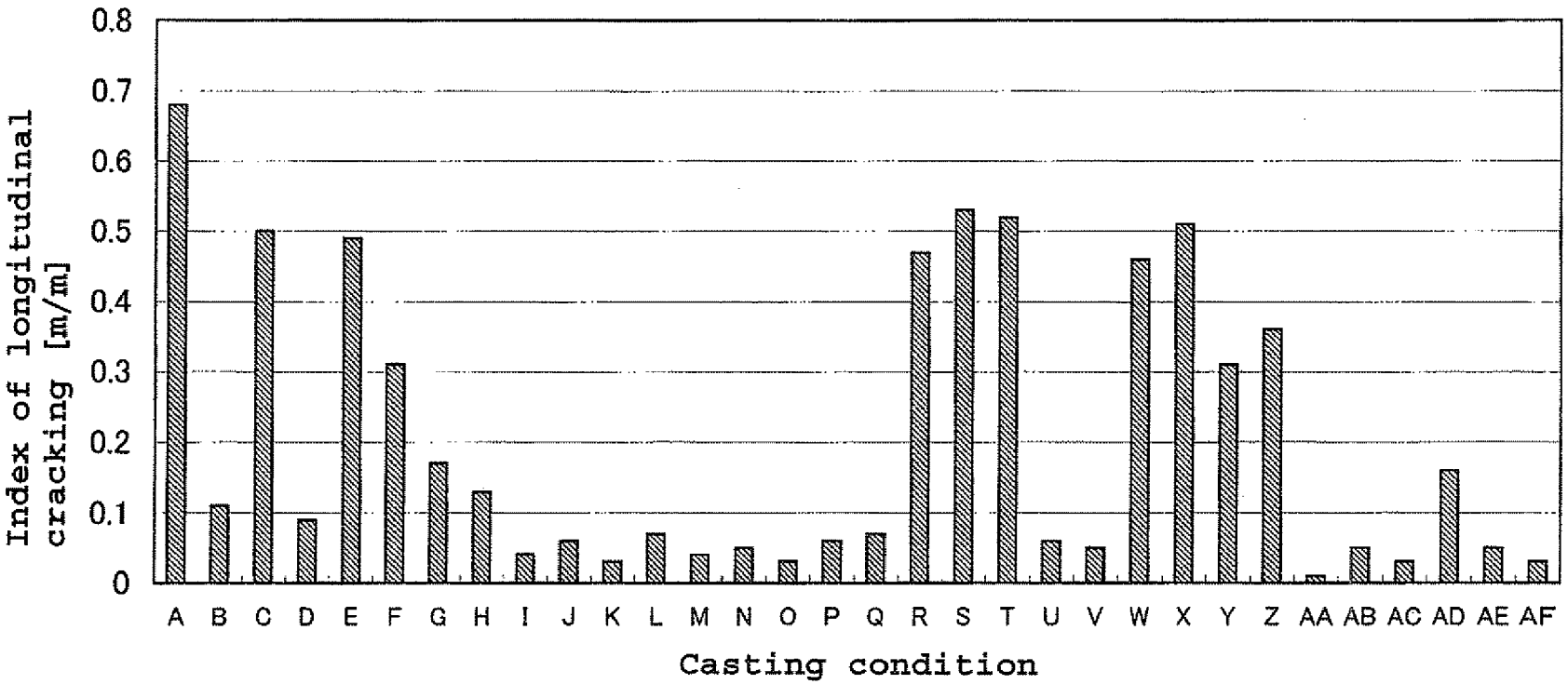
FIG. 5 is a diagram showing an index of longitudinal cracking for each casting condition in the embodiment.

FIG. 5 is a diagram showing an index of longitudinal cracking for each casting condition in the embodiment. The index of longitudinal cracking in FIG. 5 is a cracking length per unit length of the billet.

As is clear from FIGS. 4 and 5, for the casting conditions I to Q, U, V, and AA to AF of the inventive example, the variation in mold copper surface temperature fell well within a tolerable range causing no problem, and the longitudinal cracking was hardly generated. Additionally, a break out or an alarm of seizure-related constraint was not caused.

On the contrary, for the casting conditions A, C, E, F, R to T, and W to Z of the comparative example, the mold copper surface temperature exhibited a large variation which is of an issue in the commercial operation, and the large longitudinal cracking was generated. Among others, the powder P4, P5, P6, and P7 which were of the comparative example were used in the casting conditions W, X, Y, and Z, and the improper mold powder generated the large variation in copper surface temperature. For the casting conditions R, S, and T in which the molds M18, M19, and M20 as being the comparative example were used, and although the rate of change in mold inner diameter was within the proper range, the rate of change in the curvature radius of the casting apparatus was out of the proper range. Therefore, the uniform contact was not maintained between the billet and the mold inner peripheral surface.

For the casting conditions B, D, G, and H as being the comparative example, although the copper surface temperature exhibits the small variation, the molds M1, M4, M7, and M8 as being the comparative example were used. Therefore, the withdrawal-disabled accident was occurred because the rate of change in mold inner diameter was out of the proper range.

INDUSTRIAL APPLICABILITY

According to the round billet continuous casting mold of the present invention and the continuous casting method in which said mold is used, in continuously casting the round billet with the curved type continuous casting apparatus, the even force is exerted to the whole circumference of the billet, and the uniform and good contact between the billet and the mold inner peripheral surface is achieved over the whole circumference, so that the casting-defect-free high-quality round billet can stably be produced. Accordingly, the present invention is extremely useful in the continuous casting mold and the continuous casting method in which the high-quality round billet can be produced with the curved type continuous casting apparatus.

What is claimed is:

1. A mold for continuously casting a round billet with a curved type continuous casting apparatus, in which the mold has an upper edge, a lower edge, and a cooled mold surface extending between the upper and lower edges, the mold also having an inner diameter $D_0$ (m) at the lower edge thereof, and an outer curvature side thereof is configured to have a curvature radius $R_0$ (m) at the lower edge thereof, wherein D is a mold inner diameter at a distance x away from the upper edge of the cooled mold surface and dD/dx represents a change in D with respect to a change in x, and R is a curvature radius of an outer curvature side at a distance x away from the upper edge of the cooled mold surface and dR/dX represents a change in R with respect to a change in x, the mold being characterized in that:

given that a rate of change Tp (%/m) in mold inner diameter per unit length along a casting direction is expressed by Formula 1, and a rate of change Rp (%/m) in curvature radius of an outer curvature side per unit length along the casting direction is expressed by Formula 2, the rate of change Tp in mold inner diameter and the rate of change Rp in curvature radius satisfy a relationship expressed by Formula 3;

$$Tp=(1/D_0)\times(dD/dx)\times 100(\%/\mathrm{m}), \quad \text{Formula 1}$$

$$Rp=(1/R_0)\times(dR/dx)\times 100(\%/\mathrm{m}), \quad \text{Formula 2}$$

$$Rp=(Tp/2)\times(D_0/R_0) \quad \text{Formula 3.}$$

2. The round billet continuous casting mold according to claim 1,wherein the mold is divided into three regions along a casting direction, the rate of change Tp in mold inner diameter ranges from 12 to 16%/m in a first region, the first region being allocated from an upper edge of a cooled mold surface to a zone of 50-100 mm, the cooled mold surface being the side which molten steel is poured to, the zone of 50-100 mm being between the positions of 50 mm and 100 mm away from the upper mold edge, the rate of change Tp in mold inner diameter continuously varies from 12-16%/m to 0.8-1.4%/m in a second region, the second region successively following the first region and being allocated from said zone of 50-100 mm to a zone of 250-300 mm, the zone of 250-300 mm being between the positions of 250 mm and 300 mm away from the upper mold edge, and the rate of change Tp in mold inner diameter ranges from 0.8 to 1.4%/m in a third region, the third region successively following the second region and being allocated from said zone of 250-300 mm to the lower mold edge.

3. The round billet continuous casting mold according to claim 1, wherein the mold is divided into three regions along the casting direction, the rate of change Rp in curvature radius ranges from $6\times(D_0/R_0)$ to $8\times(D_0/R_0)$ (%/m) in a first region, the first region being allocated from an upper edge of a cooled mold surface to a zone of 50-100 mm, the cooled mold surface being the side which molten steel is poured to, the zone of 50-100 mm being between the positions of 50 mm and 100 mm away from the upper mold edge, the rate of change Rp in curvature radius continuously varies from $6\times(D_0/R_0)$-$8\times(D_0/R_0)$ (%/m) to $0.4\times(D_0/R_0)$-$0.7\times(D_0/R_0)$ (%/m) in a second region, the second region successively following the first region and being allocated from said zone of 50-100 mm to a zone of 250-300 mm, the zone of 250-300 mm being between the positions of 250 mm and 300 mm away from the upper mold edge, and the rate of change Rp in curvature radius ranges from $0.4\times(D_0/R_0)$ to $0.7\times(D_0/R_0)$ (%/m) in a third region, the third region successively following the second region and being allocated from said zone of 250-300 mm to the lower mold edge.

* * * * *